US011001423B2

(12) United States Patent
Porto et al.

(10) Patent No.: US 11,001,423 B2
(45) Date of Patent: May 11, 2021

(54) CONTAINER VESSEL WITH PEDESTAL LID

(71) Applicant: The Yankee Candle Company, Inc., South Deerfield, MA (US)

(72) Inventors: Paul Porto, Easthampton, MA (US); Robert W. Brown, Palmer, MA (US)

(73) Assignee: The Yankee Candle Company, Inc., South Deerfield, MA (US)

( * ) Notice: Subject to any disclaimer, the term of this patent is extended or adjusted under 35 U.S.C. 154(b) by 195 days.

(21) Appl. No.: 16/213,953

(22) Filed: Dec. 7, 2018

(65) Prior Publication Data

US 2020/0180831 A1 Jun. 11, 2020

(51) Int. Cl.
*B65D 51/24* (2006.01)
*B65D 1/22* (2006.01)
*B65D 43/02* (2006.01)

(52) U.S. Cl.
CPC ..... *B65D 51/242* (2013.01); *B65D 1/22* (2013.01); *B65D 43/0218* (2013.01); *B65D 2251/06* (2013.01); *B65D 2543/0099* (2013.01); *B65D 2543/00462* (2013.01)

(58) Field of Classification Search
CPC .... B65D 1/22; B65D 21/0223; B65D 51/242; B65D 43/0218; B65D 2251/06; B65D 2543/00462; B65D 2543/0099
USPC ..... 220/781
See application file for complete search history.

(56) References Cited

U.S. PATENT DOCUMENTS 5,586,656 A * 12/1996 Abrums ..... B65D 21/0219 206/501
6,209,725 B1 * 4/2001 Chen ..... B65D 21/0219 206/508
2012/0312812 A1 * 12/2012 Sosnovsky ..... B65D 45/22 220/23.83
2015/0274362 A1 * 10/2015 Christopher ..... B25H 3/02 206/506

* cited by examiner

*Primary Examiner* — King M Chu
(74) *Attorney, Agent, or Firm* — Husch Blackwell LLP

(57) ABSTRACT

A container assembly including a container member having a first cavity for holding a substance therein and a second cavity formed adjacent its bottom edge portion and extending upwardly therefrom, the second cavity having a top wall portion, a lid member engageable with the container member for closing access to the first cavity, the lid member having a raised wall portion configured to be receivable within the second cavity of the container member so as to form a pedestal for the container member, and at least one bumper member associated with the top wall portion of the second cavity for abutting the raised wall portion of the lid member when the lid member is inserted into the second cavity, the at least one bumper member increasing the coefficient of friction between the lid member and the container member when the lid member is received within the second cavity.

4 Claims, 9 Drawing Sheets

CONTAINER VESSEL WITH PEDESTAL LID

FIELD OF THE INVENTION

The present invention relates generally to a container which rests upon a pedestal lid and, more particularly, to a container vessel having a cavity formed in the bottom portion thereof and a pedestal lid having a raised wall portion associated therewith, the raised wall portion being cooperatively received within the cavity of the container vessel, the container cavity having a non-skid mechanism associated therewith for increasing the stability of the container vessel when placed on the pedestal lid.

BACKGROUND OF THE INVENTION

Containers which rest upon a pedestal lid are well known particularly in the candle industry. When a candle vessel or any other type of container is resting on a flat surface associated with a pedestal lid, the container or candle vessel is susceptible to sliding and rotating on the flat surface of the pedestal lid when any type of force is applied to the vessel. This is particularly true when the container or vessel is made of glass or some other smooth, slick material where the coefficient of friction between the container vessel and the pedestal lid is low thereby allowing the vessel to slide and rotate on the pedestal lid when a force is applied to the container. This is often times perceived by consumers as "instability".

The present invention is therefore directed to increasing the coefficient of friction between the bottom of the container vessel and the top of the pedestal lid without destroying the aesthetically pleasing look of the container resting on top of the pedestal lid and while, at the same time, incorporating the solution to this problem into an automated production environment.

SUMMARY OF THE INVENTION

The present invention is directed to increasing the stability of a container vessel when placed upon a pedestal lid by increasing the coefficient of friction between the bottom surface of the container vessel and the top surface of the pedestal lid. In one embodiment of the present invention, the container vessel includes a cavity or recess associated with the bottom portion of the vessel and the pedestal lid includes a raised projection or raised wall portion specifically dimensioned and configured for being received by and fitting into the cavity or recess associated with the container vessel. The cooperatively engaging recess and projection can take on a wide variety of different shapes including a square shape, a circular shape, or any other shape which can be incorporated both into the bottom portion of the container vessel and the top portion of the pedestal lid.

Since the use of glass and a wide variety of metal materials for the container vessel and/or pedestal lid result in a low coefficient of friction between the bottom portion of the container vessel and the top portion of the pedestal lid, the present invention is specifically directed to applying a plurality of small bumpers or projections to the bottom portion of the container vessel and, more particularly, to the recess or cavity formed therewithin, these bumpers or projections being in direct contact with the raised wall portion associated with the pedestal lid when the pedestal lid is engaged with the bottom portion of the container vessel. These small bumpers or projections extend downwardly from the top wall portion of the container recess or cavity and directly engage the top portion of the raised wall portion associated with the pedestal lid.

The type of material used for creating the plurality of bumpers or projections within the container cavity will dictate the increase in stability and the increase in the coefficient of friction between the pedestal lid and the container vessel. In one embodiment, an acrylated urethane class of curable adhesive is used to form the plurality of bumpers or projections. This material, when cured, is pliable, rubbery and tack-free. Once cured, this adhesive acts as an anti-slip bumper which engages the pedestal lid and increases the coefficient of friction between the container vessel and the pedestal lid anywhere from about 0.3 (need units) to a value greater than 1 (need units). The non-skid bumpers are shaped into semi spherical dots and are strategically placed within the recess or cavity of the container vessel depending upon the specific UV cured adhesive used. The semi-spherical dots or bumpers are optically clear and appear integrated into the container vessel when the container vessel is formed of glass.

It is also recognized and anticipated that a wide variety of different types of UV cured adhesives can be used and it is recognized and anticipated that other patterns and dimensions of the cured adhesive bumpers can likewise be utilized depending upon the particular application.

Other aspects and advantages of the present invention will become apparent to those skilled in the art from the following detailed description of the various embodiments of the present invention along with the accompanying drawings.

BRIEF DESCRIPTION OF THE DRAWINGS

For a better understanding of the present invention, reference may be made to the following accompanying drawings.

DETAILED DESCRIPTION OF THE INVENTION

Figure 1:
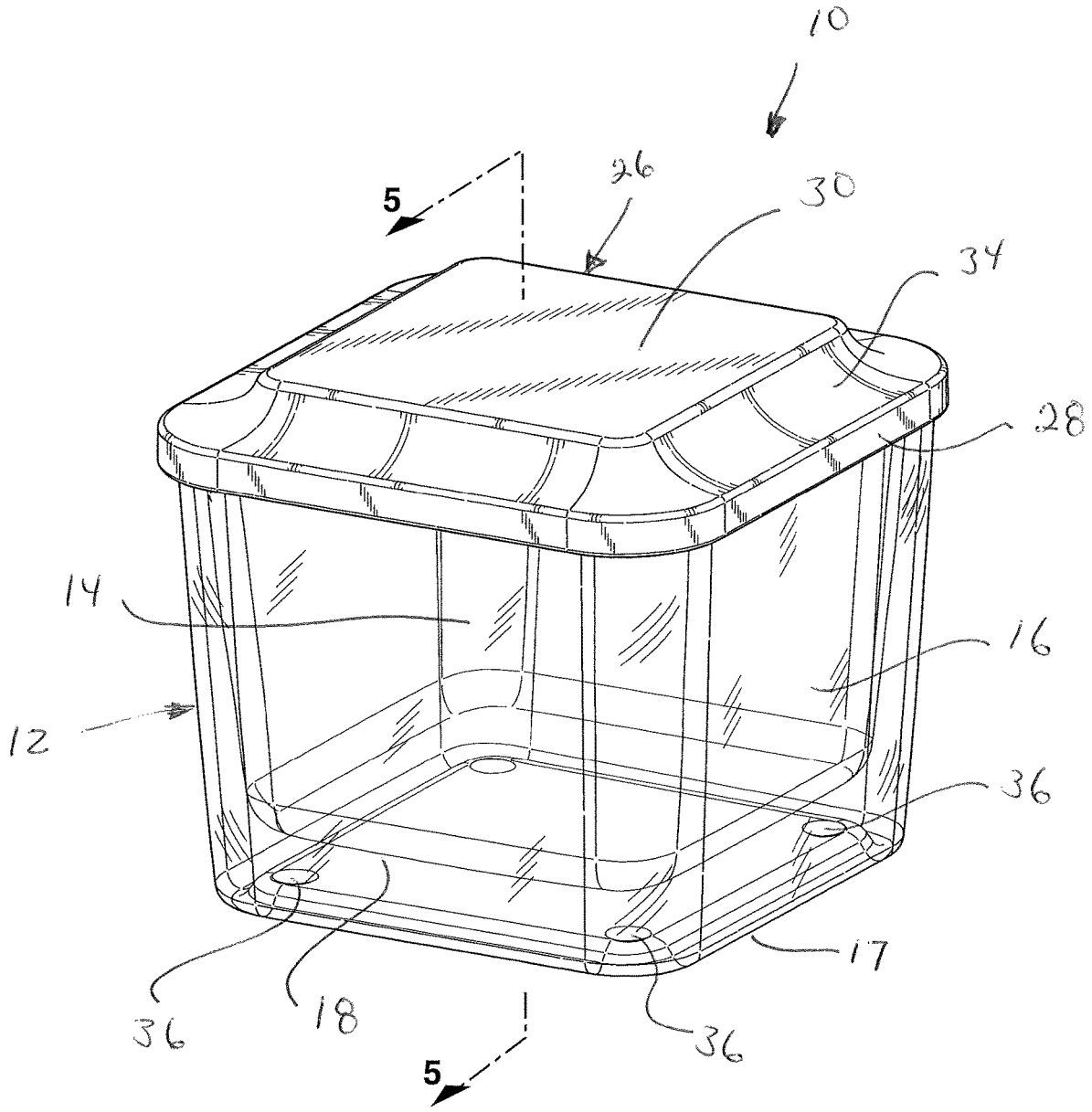
FIG. 1 is a perspective view of one embodiment of a container vessel with pedestal lid attached thereto constructed in accordance with the teachings of the present invention.

Referring to the drawings more particularly by reference numbers wherein like numerals refer to like parts, the number 10 in FIGS. 1-5 identifies one embodiment of a container vessel and associated pedestal lid constructed according to the teachings of the present invention. The container assembly 10 can be constructed for use in a wide variety of different applications such as for displaying candles, houseplants, potpourri and other decorative items. Although the specific container assemblies discussed herein are directed to candle vessels used in the candle industry, it is recognized and anticipated that the present container vessel and pedestal lid combination can be used in conjunction with any container/pedestal lid assembly used for any purpose. It is also recognized that the present container vessel and associated pedestal lid can likewise be fashioned into a variety of different sizes and shapes other than those illustrated herein and that other components associated with the present assemblies may likewise be correspondingly shaped to conform to the shape of the overall assembly without deporting from the teachings and practice of the present invention.

Figure 2:
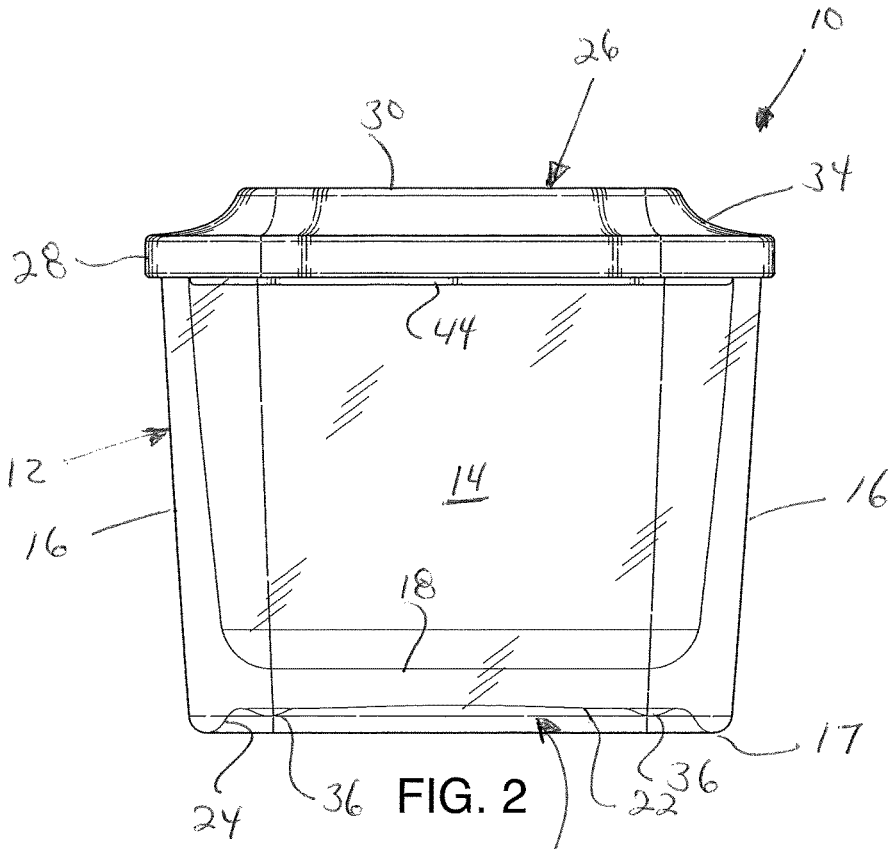
FIG. 2 is a front elevational view of the container assembly of FIG. 1.
Figure 3:
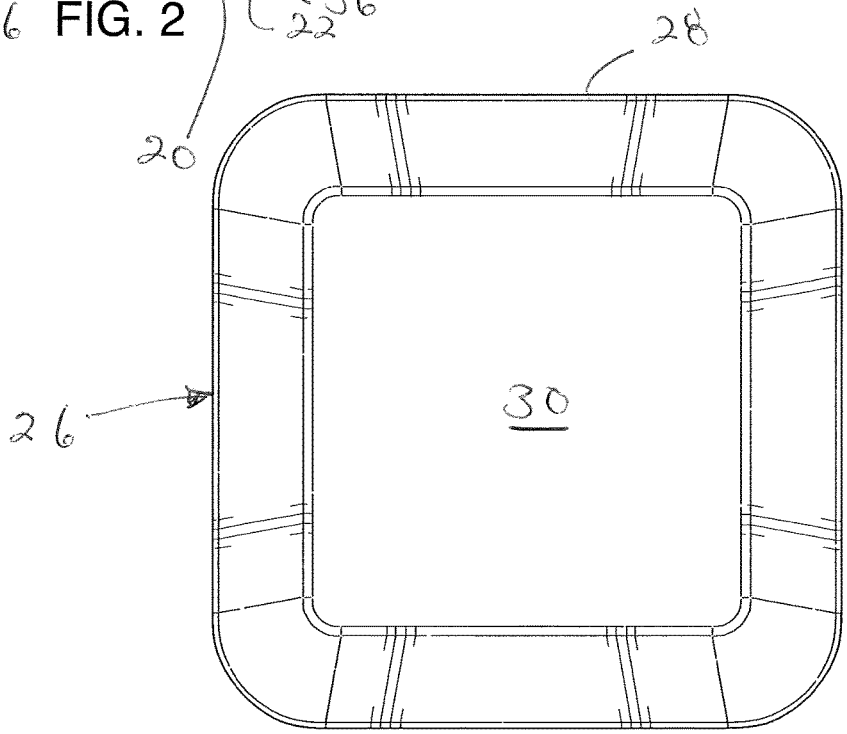
FIG. 3 is a top plan form view of the container assembly of FIGS. 1 and 2.
Figure 4:
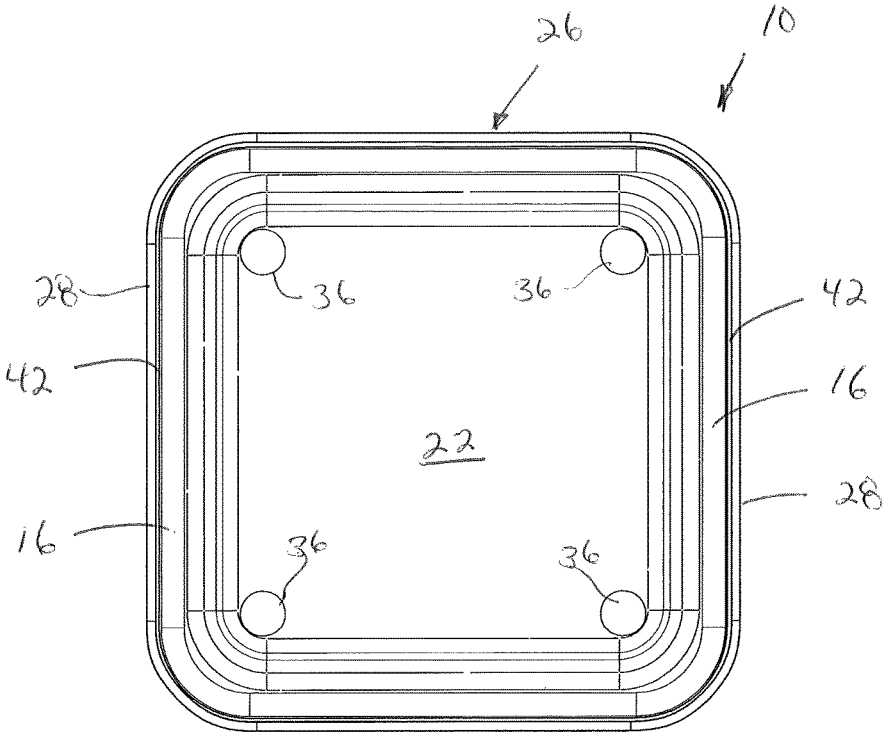
FIG. 4 is a bottom plan form view of the container assembly of FIGS. 1-3.
Figure 5:
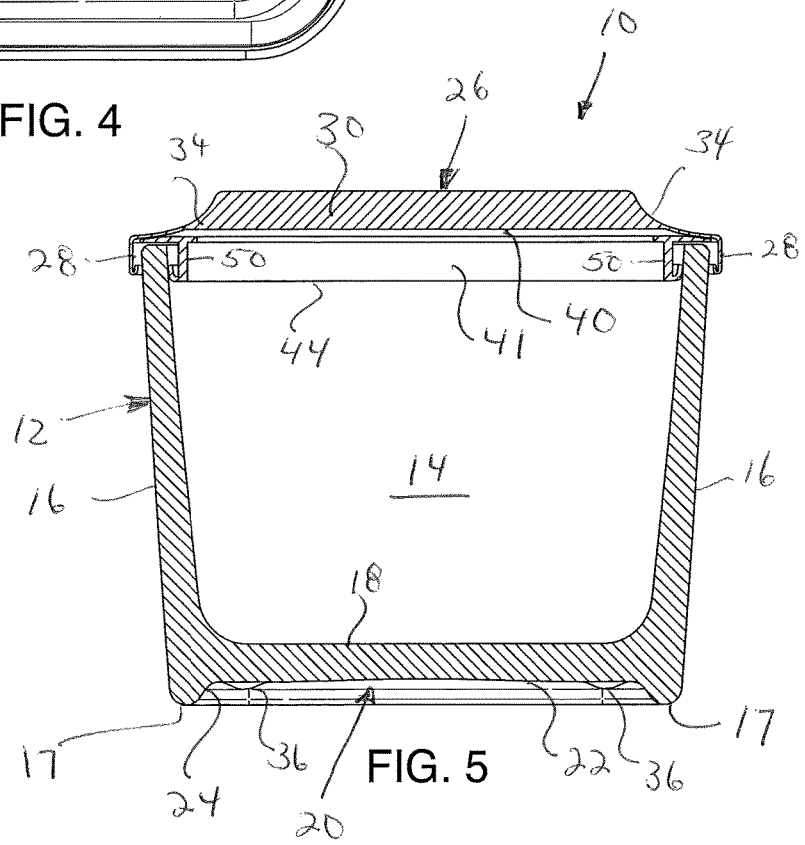
FIG. 5 is a cross-sectional view taken along line 5-5 of FIG. 1.

The container assembly 10 illustrated in FIGS. 1-5 includes a container vessel 12 having a cavity 14 formed therewithin for holding a substance within the cavity 14. The container vessel 12 is formed by a plurality of side walls 16 as best illustrated in FIGS. 1, 2 and 5, the side walls 16 having a bottom edge portion 17 as best illustrated in FIGS. 2 and 5. In the embodiment illustrated in FIGS. 1-5, the container vessel is made of glass and the cavity 14 includes a floor portion 18 which is raised above and spaced from the bottom portion of the container vessel 12 as will be hereinafter further explained. Since the container vessel illustrated in FIGS. 1-5 is made of glass, you can see into the cavity 14 and FIGS. 1-5 reflect the view into the container cavity 14.

The container vessel 12 likewise includes a second cavity or recessed portion 20 formed into the bottom wall portion of the vessel, the lower cavity 20 including a top wall portion 22 and a downwardly extending perimeter flange or side wall portion 24 as best illustrated in FIG. 5. The container vessel rests upon the bottom edge portions 17 of the container side walls 16 when positioned on a supporting surface. The cavity floor portion 18, in this embodiment, is spaced from the top wall portion 22 of the second cavity 20 as illustrated in FIGS. 1, 2 and 5.

The container assembly 10 also includes a pedestal lid 26 which includes a plurality of side walls 28 and a raised projection or raised top wall portion 30 as best illustrated in FIGS. 1, 2 and 5. The raised projection 30 is associated with the top surface of the lid member 26 and is dimensioned and configured so as to be cooperatively received by the lower bottom cavity or recess 20 associated with the container vessel 12. In this regard, the raised projection 30 may include gradually sloping side portions 34 so as to conform to the gradually sloping perimeter side wall portions 24 associated with the lower cavity 20 of the container vessel 12. Regardless of the shape of the lower cavity 20 and the perimeter side walls 24 of container cavity 20, the raised projection or wall portion 30 associated with the pedestal lid 26 is specifically designed and dimensioned so as to be cooperatively received within the lower cavity 20 regardless of its configuration.

The present invention is specifically directed to increasing the stability of the container vessel 12 when placed on top of the pedestal lid 26. This goal is achieved by specifically applying a plurality of small bumpers or projections 36 within the lower vessel cavity 20 and, more particularly, in a strategic position on the top wall portion 22 of the lower vessel cavity 20. These bumpers are positioned such that they will be in direct contact with the raised wall portion or projection 30 of the pedestal lid 26 when the pedestal lid 26 is inserted into the lower vessel cavity 20 of container 12. In the embodiment illustrated in FIGS. 1-5, the small bumpers 36 are positioned within the respective corners of the rectangular or square lower vessel cavity 20. In this regard, it is recognized and anticipated that the bumpers 36 can be placed anywhere on the top wall portion 22 of the lower vessel cavity 20 so long as they extend downwardly from such top wall portion 22 and directly engage the top portion of the raised projections 30 of the pedestal lid 26. Use of the bumper members 36 increases the coefficient of friction between the raised projection 30 of pedestal lid 26 and the container vessel 12.

The type of material used for creating the plurality of bumpers 36 within the container cavity 20 will dictate the increase in stability and how much the coefficient of friction will increase between the pedestal lid 26 and the container vessel 12. In one embodiment, a specific amount of Dymax® 1165M UV cured adhesive was applied to the top wall portion 22 of vessel cavity 20 to create the small bumpers 36. The Dymax® 1165M UV cured adhesive was applied in each corner of the lower vessel cavity 20 as best illustrated in FIG. 4 using specialized equipment and thereafter the adhesive was cured. When cured, the Dymax® 1165M UV cured adhesive was pliable and had a rubbery texture. The cured adhesive bumpers or dots 36 act as an anti-slip bumper that directly contacts the top surface of the raised projection 30 of the pedestal lid 26. Use of the Dymax® 1165M UV cured adhesive increased the coefficient of friction between a glass vessel such as the vessel 12 illustrated in FIGS. 1-5 and the pedestal lid 26 from a value of 0.3 to a value greater than 1.0. This increase in the coefficient of friction was sufficient to prevent the container vessel 12 from sliding and/or rotating on the pedestal lid 26 when a force was applied to the container 12.

The Dymax® 1165M UV cured adhesive is an acrylated urethane class adhesive. It is recognized and anticipated that any type of acrylated urethane class adhesive may be used to form the small bumpers 36. It is also recognized and anticipated that a wide variety of other adhesives including UV cured adhesives, or a wide variety of other materials can be used to increase the coefficient of friction between the lower vessel cavity 20 and the pedestal lid 26. In the particular embodiment illustrated in FIGS. 1-5, the non-skid bumpers 36 are shaped into semispherical dots and are strategically placed within the recess or cavity 20 of the vessel 12 depending upon the specific adhesive utilized. The semispherical dots or bumpers 36, when formed using Dymax® 1165M, are optically clear and appear integrated into the container vessel 12 when the container vessel is formed of glass. When cured, this adhesive is pliable, rubbery and tack-free. In its uncured state, the Dymax® 1165M adhesive is viscus and slow to spread. Due to these physical properties, a consistent sized dot or bumper 36 can be created by controlling the dosing of the adhesive in its uncured state and providing a near instantaneous cure using UV curing technology.

In many industries, such as the candle industry where a glass vessel is wicked and filled with wax, it is important to integrate the application of the small bumpers or dots 36 into the container vessel 20 during the automated production process of producing a container with the candle wick and wax incorporated therewithin. The application of the Dymax® 1165M adhesive, or any other adhesive, or other higher coefficient of friction material is applied to the container vessel 12 before the container is filled with any appropriate material. For example, the vessel 12 can be loaded, bottom up, onto a single wide conveyor such that the container vessel lower cavity 20 is exposed. The vessel 12 then travels down the conveyor and is secured by a clamp or other mechanism on either side of the container 12. A plurality of nozzles with a specific pattern are lowered towards the vessel cavity 20 as the vessel moves on the conveyor and the nozzles dispense any plurality of spots of adhesive onto the top wall 22 of container cavity 20. The amount of adhesive dispensed from the nozzles is pneumatically controlled during the production process. A container 12 then moves by the conveyor into a UV curing tunnel so as to cure the adhesive if an acrylated urethane class of adhesive is being used. The vessel 12 is then flipped over and fed into the remainder of the production process, for example, a candle production process, so as to fill the container with a wick and wax or other material depending upon the production process. Once cured, the adhesive acts as an anti-slip bumper on the pedestal lid 26 when the pedestal lid is engaged with the container cavity 20.

It is important to recognize that the small bumpers 36 are shorter in height or depth than the height or depth of the perimeter wall 24 forming the lower container cavity 20. This allows the raised portion 30 of the pedestal lid to be received by the container cavity 20 and allows a sufficient portion of the raised portion 30 to seat within the cavity 20. This allows the perimeter wall 24 to also provide stability to the container vessel 12 when the vessel 12 is seated on the pedestal lid 26. The height or depth of the perimeter wall 24 can vary depending upon the size of the container 12.

Figure 6:
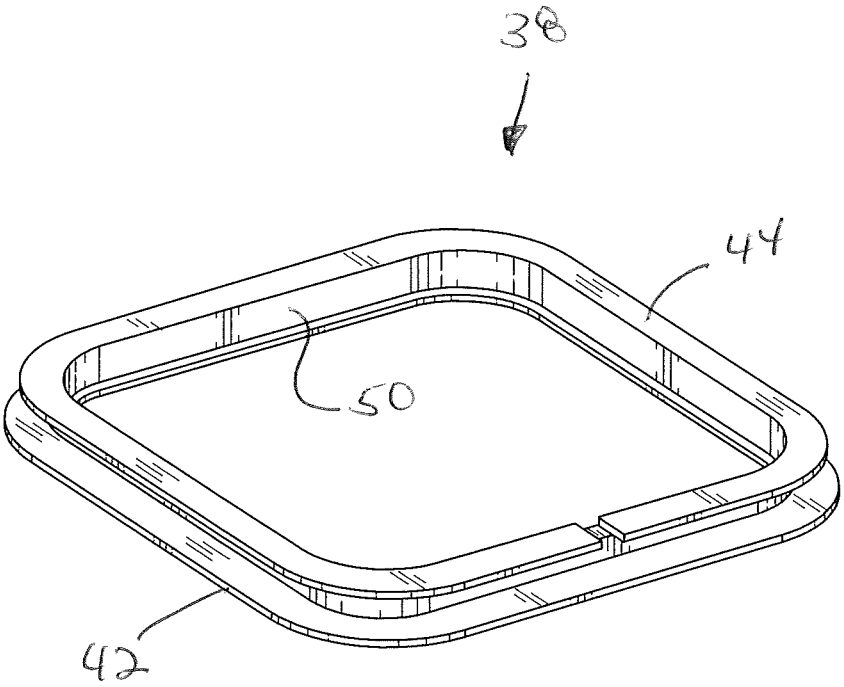
FIG. 6 is a perspective view of one embodiment of a gasket member used in association with the pedestal lid constructed in accordance with the teachings of the present invention.

In still another embodiment, the pedestal lid 26 may include a gasket member 38 as best illustrated in FIGS. 5 and 6. Gasket member 38 is sized, shaped and dimensioned so as to be attached to the interior wall portion 40 within the interior space 41 of the pedestal lid 26. In this regard, the gasket 38 includes a lower flange portion 42 and an upper flange portion 44 as best illustrated in FIG. 6. The two flange portions 42 and 44 are joined together by wall portion 50, flange portion 44 being spaced from flange portion 42 by wall portion 50. Flange portion 42 is specifically sized and shaped so as to be attached to the interior wall portion 40 of pedestal lid 26 adjacent the side walls 28 of pedestal lid 26. The flange portion 42 can be attached to lid wall portion 40 using any conventional means including using an adhesive. Once attached to the lid wall member 40, the annular flange 44 of gasket member 38 extends slightly below the bottom edge portion of side walls 28 of pedestal lid 26 as best illustrated in FIGS. 2 and 5. When the gasket member 38 is positioned and attached to the pedestal lid 26, and when the pedestal lid 26 is placed on a supporting surface and engaged with the container vessel 12, the flange portion 44 of gasket member 38 likewise makes contact with the supporting surface and provides another contacting surface with the supporting surface to further prevent the pedestal lid from sliding or rotating on the supporting surface when a force is applied to either the container vessel 12 or the pedestal lid 26. In this regard, the gasket member 38 can be made of silicon or other non-skid material to further increase the stability of the container vessel 12 when placed on the pedestal lid 26. As such, the combination of the anti-slip bumpers 36 and the gasket member 38 associated with the pedestal lid 26 provide a container assembly 10 that noticeably resists horizontal and rotational movement when a force is applied to either the container 12 or the pedestal lid 26.

Figure 7:
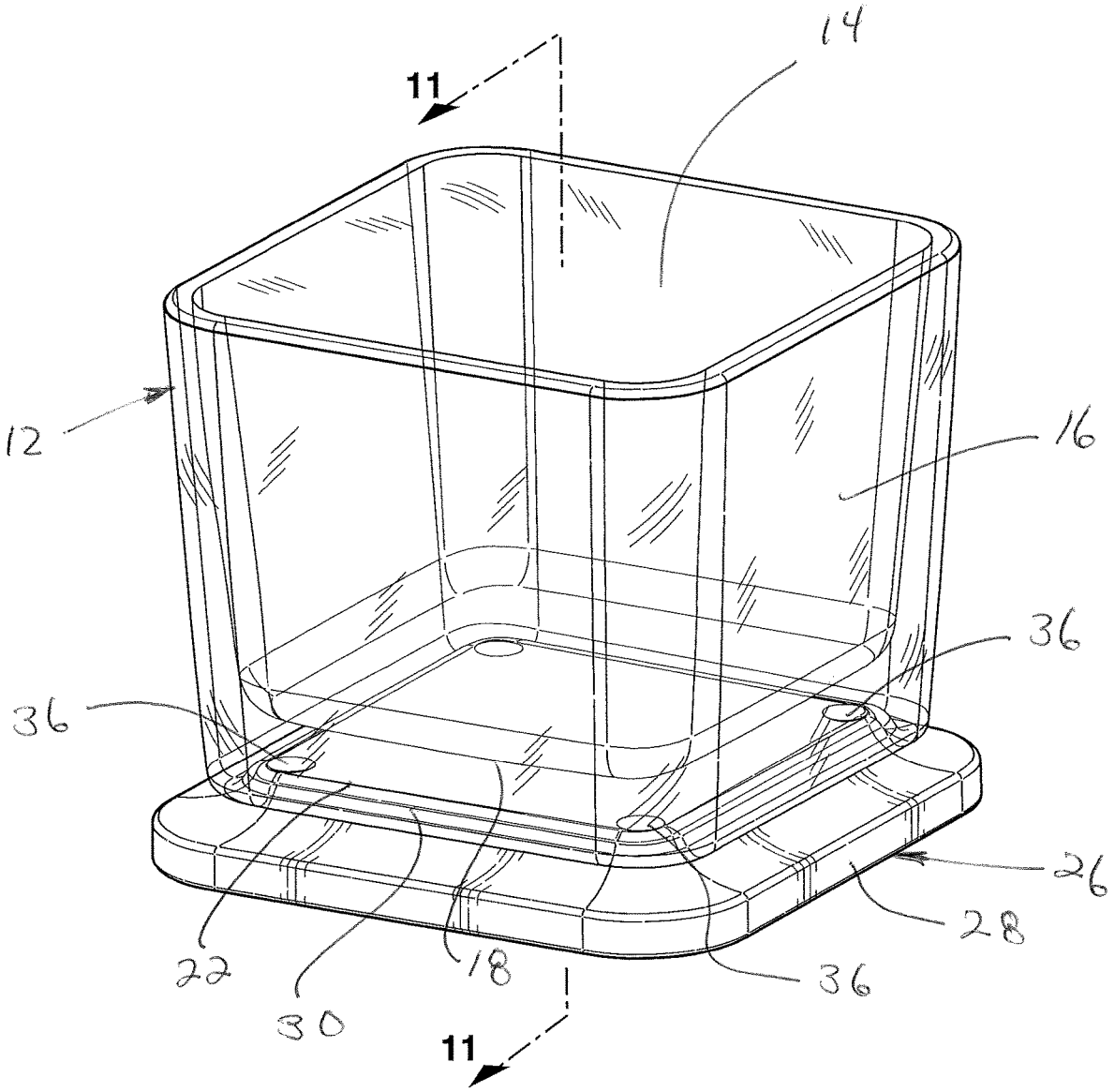
FIG. 7 is a perspective view of the container assembly of FIGS. 1-5 with the container vessel resting on the pedestal lid.
Figure 8:
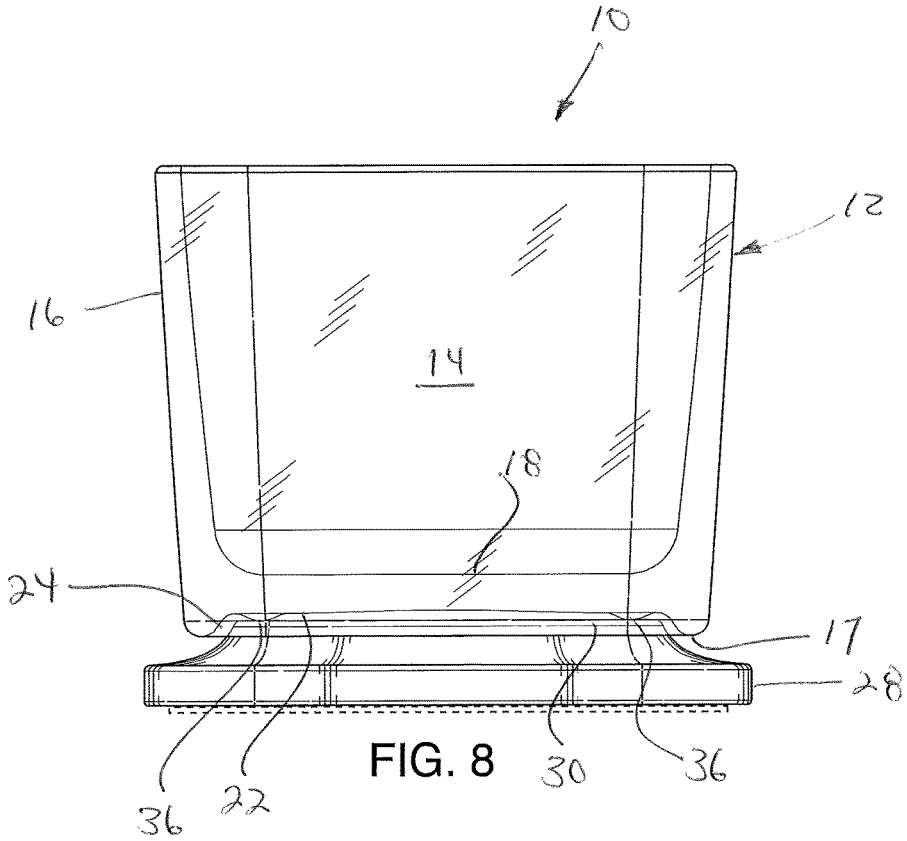
FIG. 8 is a front elevational view of the container assembly of FIG. 7.
Figure 9:
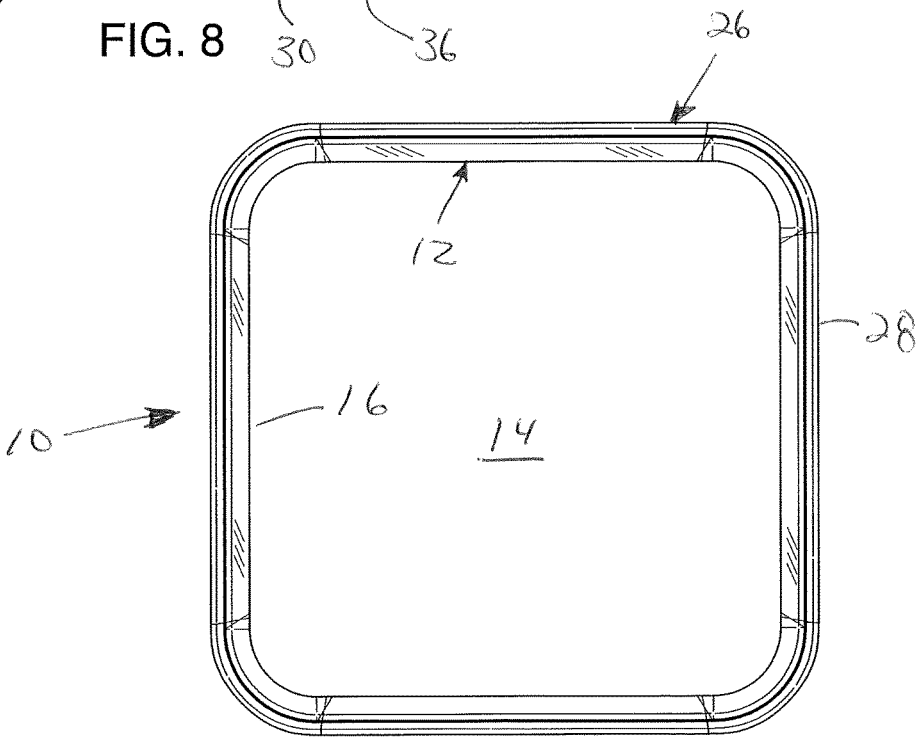
FIG. 9 is a top plan form view of the container assembly of FIG. 7.
Figure 10:
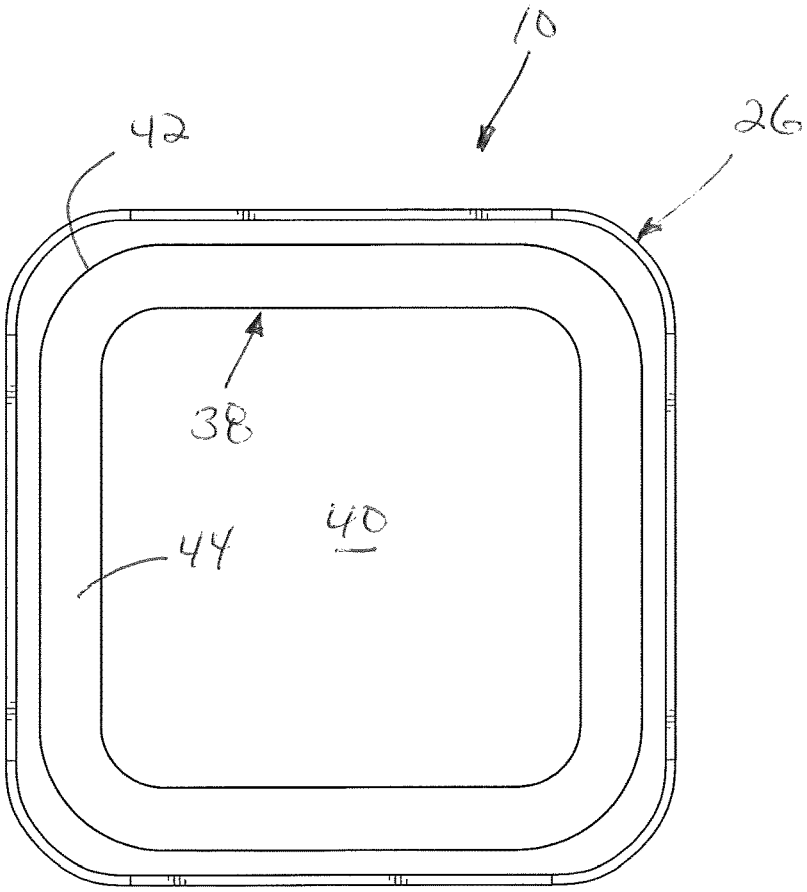
FIG. 10 is a bottom plan form view of the container assembly of FIG. 7.
Figure 11:
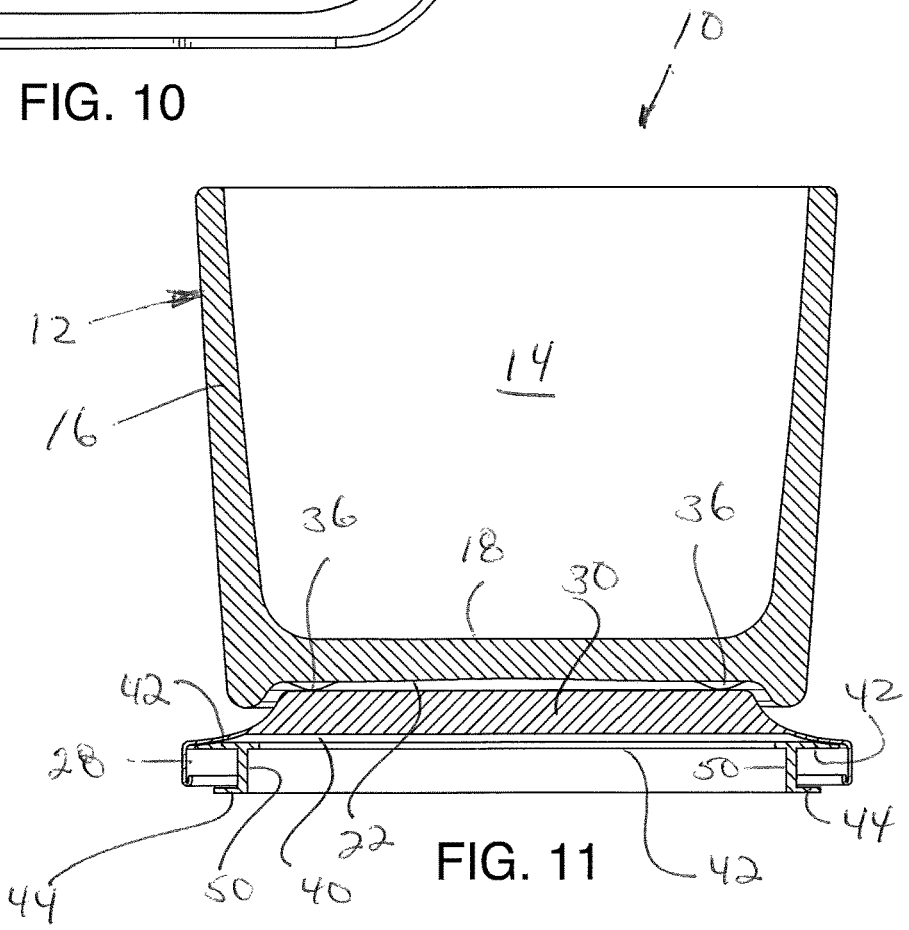
FIG. 11 is a cross-sectional view taken along line 11-11 of FIG. 7.

FIGS. 7-11 illustrate container vessel 12 seated and resting upon pedestal lid 26. Since container vessel 12 is illustrated as being a glass vessel, you can see the positioning and location of the small bumpers 36 associated with the top wall portion 22 of the lower container vessel 20 when the container 12 is seated on the raised wall portion 30 of the pedestal lid 26 as best illustrated in FIGS. 7, 8 and 11. FIG. 11 also illustrates use of the gasket member 38 and illustrates how flange portion 44 of gasket member 38 extends below the lower edge portion of the side wall portions 28 of the pedestal lid 26 so as to contact the supporting surface upon which the pedestal lid rests.

Figure 12:
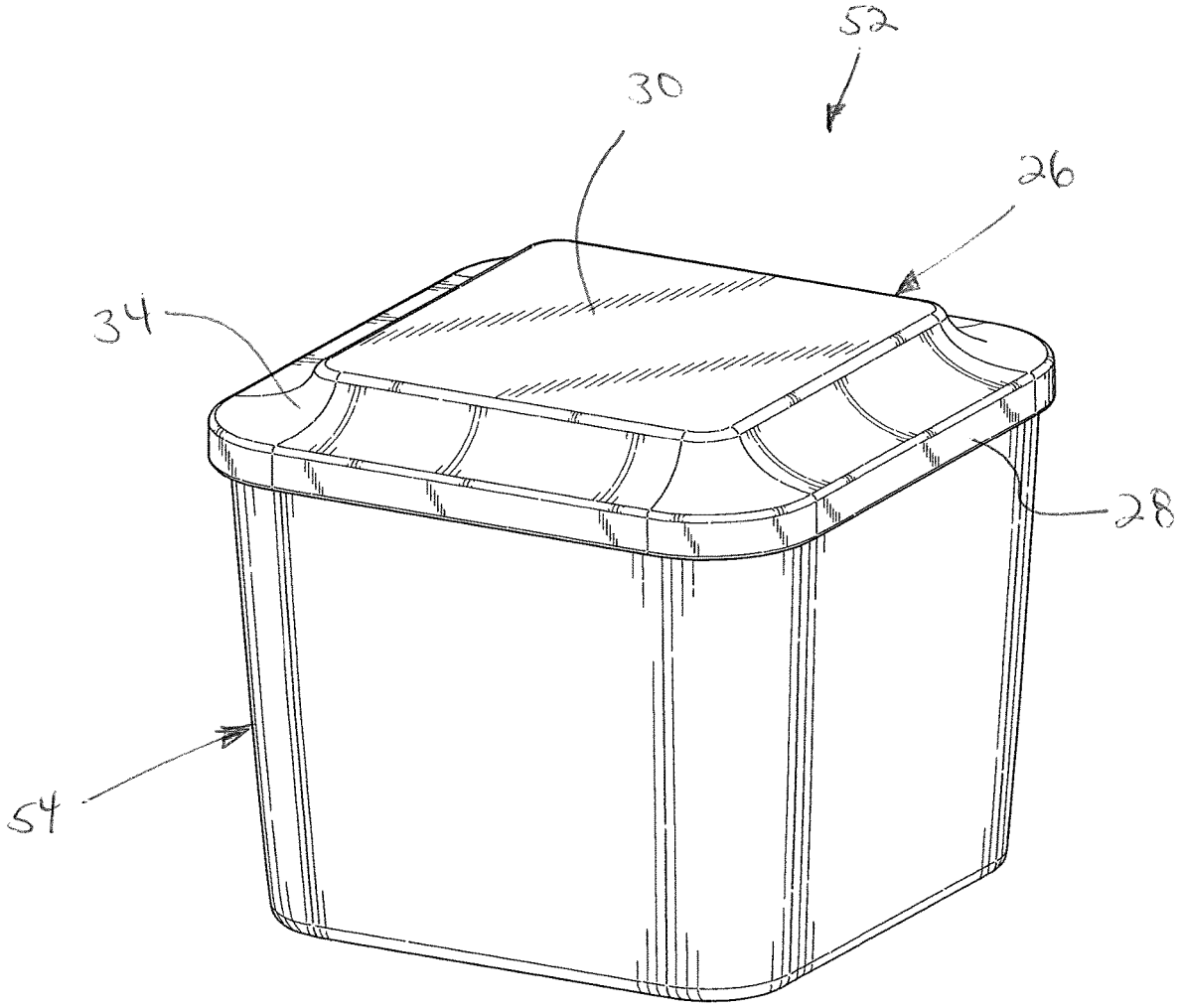
FIG. 12 is a perspective view of another embodiment of a container vessel with pedestal lid constructed according to the teachings of the present invention wherein the container vessel is made of an opaque material.
Figure 13:
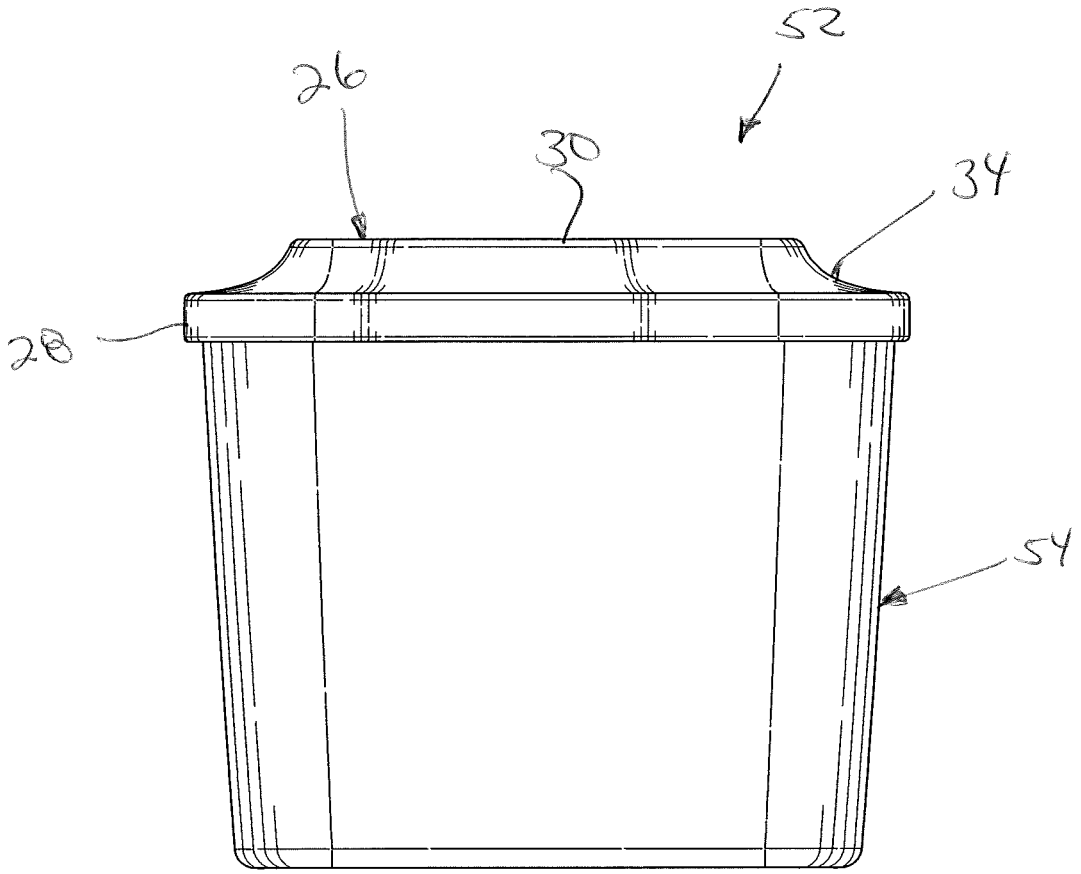
FIG. 13 is a front elevational view of the container assembly of FIG. 12.

FIGS. 12 and 13 illustrate still another embodiment 52 of the present container assembly wherein the container vessel 54 is made of an opaque material such that you cannot see inside the container vessel 54. In all other respects, the container vessel 54 is constructed substantially identical to container vessel 12 including having a lower recessed cavity 20 associated therewith as well as a plurality of strategically placed bumpers 36 not visible in FIGS. 12 and 13. Similarly, the pedestal lid 26 associated with container assembly 52 is identical to pedestal lid 26 associated with the embodiment illustrated in FIGS. 1-5 and its structure is identical.

It is also recognized and anticipated that the size and shape of the container vessels 12 and 54 illustrated herein can take on a wide variety of different shapes including rectangular, square, circular, hexagonal and other shapes and that the pedestal lid 26 can be sized and dimensioned so as to fit the shape of the container vessel 12 and 54. It is also recognized that the gasket member 38 can be shaped and dimensioned so as to fit the size and shape of the pedestal lid 26. Still further, it is recognized and anticipated that the plurality of small bumpers or dots 36 could be formed by other manufacturing processes including a roll configuration process and that the individual bumpers 36 could be applied using a specially designed applicator, or such bumpers 36 could be hand attached to the top wall portion 22 of the lower container vessel 20. Additionally, the patterns and dimensions of the bumpers 36 can vary and can take on a wide variety of different shapes and sizes and it is recognized that a single bumper 36 could be utilized in certain applications depending upon the size and shape of the container vessels 12 and 54, although a plurality of bumpers 36 are generally preferred. It is also recognized and anticipated that the bumpers 36 do not need to be positioned in the respective corners of the cavity 20 as illustrated in FIGS. 1-5, but such bumpers 36 could be positioned at other locations on the top wall portion 22 of lower container cavity 20. It is also recognized that the bumpers 36 could be made from or formed of other non-stick materials and that such bumpers do not necessarily need to be made from an adhesive substance.

Although the present container vessels 12 and 54 are typically used in the candle industry, it is recognized and anticipated that the use of the present bumpers 36 can be applied to any container that needs to rest on a pedestal lid such as pedestal lid 26 regardless of what is contained or positioned within the container vessel.

Thus, there has been shown and described several embodiments of as novel container assembly which is adaptable for use in a wide variety of different applications where the container vessel is placed on a pedestal lid. The present embodiments fulfill all of the objects and advantages sought therefore. Many changes, modifications, variations and other uses and applications of the present invention will, however, become apparent to those skilled in the art after considering the present specification and the accompanying drawings. All such drawings, modifications, variations and other uses and applications which do not depart from the spirit and scope of the present invention are deemed to be covered by the present invention which is limited only by the claims which follow.

The invention claimed is:

1. A container assembly for holding a substance therewithin comprising:

a container member having side walls and a bottom edge portion associated therewith, said container member having a first cavity formed therein, said first cavity having a bottom wall portion, said container member having a recess formed adjacent the bottom edge portion of said side walls and extending upwardly from said bottom edge portion, said recess having a top wall portion and a side wall portion, the bottom wall portion of said first cavity being spaced from the top wall portion of said recess;

a lid member engageable with said container member for closing access to said first cavity, said lid member having side walls, an upper surface, and a raised wall portion associated with said upper surface, said raised wall portion being configured so as to be receivable within the recess of said container member, and a gasket member insertable within said lid member, said gasket member having a first flange portion engageable with said lid member and a second flange portion which extends below a bottom edge portion of the side walls forming said lid member; and a plurality of bumper members associated with the top wall portion of said recess, said plurality of bumper members being formed from a UV cured adhesive of the acrylated urethane class, said plurality of bumper members abutting the raised wall portion of said lid member when said raised wall portion is inserted into said recess, each of said plurality of bumper members having a depth less than the depth of the side wall forming said recess.

2. The container assembly of claim 1 wherein each of said plurality of bumper members is formed from a UV cured adhesive.

3. The container assembly of claim 1 wherein when the raised wall portion of said lid member is received within said recess and said lid member is placed on a supporting surface, the second flange portion of said gasket member rests upon said supporting surface.

4. The container assembly of claim 3 wherein said gasket member is made of a silicone material.

* * * * *